US005292631A

United States Patent [19]

Hershey et al.

[11] Patent Number: 5,292,631

[45] Date of Patent: Mar. 8, 1994

[54] RADIOGRAPHIC ELEMENTS WITH IMPROVED COVERING POWER

[75] Inventors: Stephen A. Hershey; J. Ramon Vargas; Paul A. Burns, all of Rochester, N.Y.

[73] Assignee: Eastman Kodak Company, Rochester, N.Y.

[21] Appl. No.: 892,851

[22] Filed: Jun. 3, 1992

[51] Int. Cl.[5] ..... G03C 1/035; G03C 1/06

[52] U.S. Cl. ..... 430/567; 430/611; 430/614; 430/615; 430/966

[58] Field of Search ..... 430/233, 356, 402, 502, 430/611, 565, 567, 614, 615, 966

[56] References Cited

U.S. PATENT DOCUMENTS

| | | | |
|---|---|---|---|
| 4,425,425 | 1/1984 | Abbott et al. | 430/502 |
| 4,720,447 | 1/1988 | De Keyzer et al. | 430/244 |
| 4,727,017 | 2/1988 | Pollet et al. | 430/611 |
| 4,728,601 | 3/1988 | Rowland et al. | 430/565 |
| 4,859,565 | 8/1989 | De Keyzer et al. | 430/231 |

FOREIGN PATENT DOCUMENTS

0430115A1 6/1991 European Pat. Off. .

*Primary Examiner*—Janet C. Baxter
*Attorney, Agent, or Firm*—Carl O. Thomas

[57] ABSTRACT

Monocyclic and polycyclic azoles having the following formula enhance the covering power of a developed silver image formed from a radiographic element comprising a radiation sensitive tabular grain silver bromide, silver bromochloride or silver bromoiodide emulsion layer containing grains having a mean equivalent circular diameter of at least 0.3 μm and a grain population wherein at least 50 percent of the total grain population projected area is accounted for by tabular grains having a tabularity of greater than 8, as determined by the relationship:

$$T = \frac{ECD}{t^2}$$

wherein T is tabularity; ECD is the mean effective circular diameter in μm of the tabular grains; and t is the mean thickness in μm of the tabular grains. The azoles have the formula:

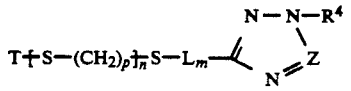

(I)

wherein

Z is —N= or —C($R^5$)= where $R^5$ is hydrogen, —$NH^2$, aliphatic of 1 to 8 carbon atoms or aromatic of 1 to 8 carbon atoms;

$R^4$ is hydrogen, aliphatic of 1 to 8 carbon atoms or aromatic of 1 to 8 carbon atoms;

$R^4$ and $R^5$ together complete a 5 or 6 membered heterocyclic nucleus containing 1 to 3 ring nitrogen atoms;

L is a divalent aliphatic linking group containing 1 to 8 carbon atoms;

T is an aliphatic terminal group containing 1 to 10 carbon atoms;

m is 0 or 1;

n is an integer of 0 to 4; and p is an integer of 2 to 4.

16 Claims, No Drawings

RADIOGRAPHIC ELEMENTS WITH IMPROVED COVERING POWER

FIELD OF THE INVENTION

This invention relates to radiographic imaging. More particularly, the invention relates to silver images formed from radiation sensitive silver bromide, silver bromochloride or silver bromoiodide tabular grains. In a specific aspect this invention relates to a silver image forming radiographic element that has an emulsion layer containing radiation sensitive silver bromide, silver bromochloride or silver bromoiodide tabular grains and contains an azole which is effective to increase the covering power of the silver image formed upon development of such grains.

BACKGROUND

In medical radiography an image of a patient's tissue and bone structure is produced by exposing the patient to X-radiation and recording the pattern of penetrating X-radiation using a radiographic element containing at least one radiation sensitive silver halide emulsion layer coated on a transparent (usually blue tinted) support. The X-radiation can be directly recorded by the emulsion layer where only limited areas of exposure are required, as in dental imaging and the imaging of body extremities. However, a more efficient approach, which greatly reduces X-radiation exposures, is to employ an intensifying screen in combination with the radiographic element. The intensifying screen absorbs X-radiation and emits longer wavelength electromagnetic radiation which silver halide emulsions more readily absorb. Another technique for reducing patient exposure is to coat two silver halide emulsion layers on opposite sides of the film support to form a "double coated" radiographic element. Diagnostic needs can be satisfied at the lowest patient X-radiation exposure levels by employing a double coated radiographic element in combination with a pair of intensifying screens. The imagewise exposed and processed radiographic element is primarily intended for viewing by transmitted light. In a typical situation a medical radiologist studies the silver image with the radiographic element mounted on a light box, a white translucent illumination source.

Radiographic elements that contain tabular grain silver halide emulsion layers are described in the art and are known to provide advantages over radiographic elements that comprise layers of the more conventional spherical grain silver halide emulsions. See, for example, U.S. Pat. Nos. 4,994,355, issued Feb. 19, 1991; 5,021,327, issued Jun. 4, 1991 and 5,041,364, issued Aug. 20, 1991.

As illustrated by European Patent Application No. 0 430 115 A1, published Jun. 5, 1991, (hereinafter referred to simply as EP 0 430 115 A1), it is also known that radiographic elements containing tabular grain silver halide layers sometimes have lower silver covering power than is desired. EP 0 430 115 A1 describes increasing the covering power of a tabular grain silver halide emulsion in a radiographic element by adding to the emulsion a heterocyclic thione having the following formula:

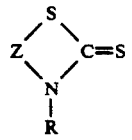

wherein Z represents sufficient carbon atoms to form a 5 membered or aromatic ring, or substituted 5 membered or aromatic ring, and R is an alkyl of 1–5 carbon atoms, a sulfoalkyl group of 2–5 carbon atoms, a dialkyl aminomethyl or a a hydroxymethyl group.

It is desirable to increase the covering power of radiographic elements containing tabular grain silver halide layers because this provides higher density for a given amount of silver or the same density from a lesser amount of developed silver. Increased silver density is desirable from the medical radiologist's point of view since a higher density image can provide more detail and aid in making a diagnosis. Furthermore, from a manufacturing and cost point of view, it is desirable to reduce the amount of silver that is necessary to coat a silver halide emulsion layer in a radiographic element.

U.S. Pat. Nos. 4,720,447 and 4,859,565 may, upon superficial examination, appear to be of some interest with respect to this invention since these patents describe the use of heterocyclic azole compounds as "density-and/or tone controlling compounds". However, these patents simply describe using such compounds in a photographic silver complex diffusion transfer reversal process (simply referred to as DTR process) wherein a silver image is formed in a non-radiation sensitive layer from a soluble silver salt. There is no suggestion that such compounds would have any effect in modifying the covering power of a silver image formed in the DTR process, much less a silver image formed from a tabular grain radiation sensitive silver halide emulsion of the type used in the present invention. Furthermore, each of the aforementioned patents teach and demonstrate that the heterocyclic azoles described therein do not substantially affect transmission densities ($D_{TR}$) measured on silver images formed in the DTR process. See, for example, Tables 2 and 3 in each of the aforementioned patents. Accordingly, it is evident that U.S. Pat. Nos. 4,720,447 and 4,859,565 are not pertinent to the invention described herein which pertains to the use of a specific class of heterocyclic azoles to increase the covering power of a silver image formed from a radiographic element comprising a radiation sensitive tabular grain silver halide emulsion layer.

U.S. Pat. No. 4,728,601 describes the use of certain 2-alkylthio-4-hydroxy-1,3,3a,7-tetraazaindenes to modify the image tone in photographic elements and impart a netural tone to a developed silver image formed upon exposure and processing of the element. Such image toning materials have the following formula:

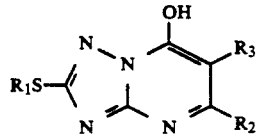

Wherein $R_1$ is alkyl containing 6 to 11 carbon atoms or is a ring system and the groups $R_2$ and $R_3$ are each individually hydrogen or alkyl containing 1 to 4 carbon atoms.

There is no suggestion in U.S. Pat. No. 4,728,601 that the tetraazaindene compounds described therein have any effect upon the covering power of the silver halide emulsions described in the patent and, of course, contains no teachings with respect to radiation sensitive tabular silver halide emulsions. The patent is, however, of some interest with respect to the present invention since a number of the compounds described therein have been found to be effective to increase the covering power of silver images formed from radiation sensitive tabular silver halide emulsions according to this invention.

In light of the previous discussion, it is evident that it is very desirable to increase the covering power of developed silver formed from radiation sensitive tabular grain silver halide emulsions. Likewise, it would be desirable to have a silver image forming radiographic element comprising a radiation sensitive tabular grain silver halide emulsion layer that provides a silver image exhibiting increased covering power upon exposure and processing. This invention meets such desirable objectives.

RELATED CONCURRENTLY FILED U.S. PATENT APPLICATIONS

U.S. patent application Ser. No. 07/892,850, filed Jun. 3, 1992, entitled "Tone Control of Photographic Images", S. A. Hershey, J. R. Vargas and Paul A. Burns, pertains to the use of monocyclic and polycyclic azoles having an aliphatic substituent containing multiple sulfur atoms to modify the tone of a silver image formed from a fine grain radiation sensitive silver bromide or silver bromoiodide emulsion layer in which the silver bromide or silver bromoiodide grains have a mean equivalent circular diameter of less than 0.3 μm.

U.S. patent application Ser. No. 07/892,846, filed Jun. 3,1992, entitled "Tone Control of Photographic Silver Images", S. A. Hershey, J. R. Vargas and Paul A. Burns, pertains to the use of monocyclic and polycyclic azoles having an aliphatic substituent containing multiple sulfur atoms to modify the tone of a silver image formed from a fine grain radiation sensitive silver chlorobromide emulsion layer in which the silver chlorobromide grains contain up to 70 mole percent chloride and have a mean equivalent circular diameter of less than 0.3 μm.

SUMMARY OF THE INVENTION

In accordance with this invention, a certain class of azoles, as described hereinafter, is used to increase the covering power of the silver image formed from a radiation sensitive tabular grain silver bromide, silver bromochloride or silver bromoiodide emulsion. Thus, this invention provides a silver image-forming radiographic element comprising a transparent support having thereon an emulsion layer containing radiation sensitive silver bromide, silver bromochloride or silver bromoiodide grains having a mean equivalent circular diameter of at least 0.3 μm and a grain population wherein at least 50 percent of the total grain population projected area is accounted for by tabular grains having a tabularity of greater than 8, as determined by the relationship:

$$T = \frac{ECD}{t^2}$$

wherein T is tabularity; ECD is the mean effective circular diameter in mm of the tabular grains; and t is the mean thickness in mm of the tabular grains. Such element contains an azole that is present in a concentration effective to increase the covering power of the silver image, and has the formula:

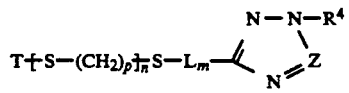

(I)

wherein Z is —N= or —C($R^5$)= where $R^5$ is hydrogen, —$NH_2$, aliphatic of 1 to 8 carbon atoms or aromatic of 1 to 8 carbon atoms; $R^4$ is hydrogen, aliphatic of 1 to 8 carbon atoms or aromatic of 1 to 8 carbon atoms; $R^4$ and $R^5$ together complete a 5 or 6 membered heterocyclic nucleus containing 1 to 3 ring nitrogen atoms; L is a divalent aliphatic linking group containing 1 to 8 carbon atoms; T is an aliphatic terminal group containing 1 to 10 carbon atons; m is 0 or 1; n is an integer of 0 to 4; and p is an integer of 2 to 4.

In practicing the invention, increased covering power of the silver image is achieved simply by developing the radiation sensitive tabular grain silver bromide, silver bromochloride or silver bromoiodide emulsion layer in the presence of the aforementioned azole. Such processing can be accomplished using conventional X-ray processing techniques, for example, rapidacess X-ray processing techniques in which processing is completed in 90 seconds or less.

DETAILED DESCRIPTION OF THE INVENTION

The emulsion layers used in the radiographic elements of this invention are formed from radiation sensitive tabular grain silver bromide, silver bromochloride or silver bromoiodide emulsions having a tabularity of greater than 8, as determined by the relationship $$T = \frac{ECD}{t^2},$$

as described previously herein.

Such tabular grain silver halide emulsions exhibit advantageous photographic properties and include (i) high aspect ratio tabular grain silver halide emulsions and (ii) thin, intermediate aspect ratio tabular grain silver halide emulsions. High aspect ratio tabular grain emulsions are those in which the tabular grains exhibit an average aspect ratio of greater than 8:1, often 12:1 or more. Thin, intermediate ratio tabular grain emulsions are those in which the tabular grain emulsions of a thickness of 0.2 μm have an average aspect ratio in the range of from 5:1 to 8:1. The common feature of high tabularity emulsions is that their tabular grain thickness is reduced in relation to the equivalent circular diameter of tabular grains which have been known to exist to some degree in conventional silver halide emulsions. When any combination of tabular grains having a tabularity of greater than 8, often 25 or greater for the high tabularity grains, in a statistically significant grain sample accounts for at least 50 percent, preferably at least 70 percent and optimally at least 90 percent, of the total grain population projected area of the grains in the sample, the emulsion satisfies the tabular grain requirements of the invention. The tabularities are typically greater than 25 and are often greater than 40 or even 60. Tabularities can range up to 1,000 or higher, but are generally chosen to be less than about 500.

The grain size of the radiation sensitive silver bromide, silver bromochloride or silver bromoiodide grains in the emulsion layers employed in the practice of this invention are subject to some variation, but in general the grains have a mean equivalent circular diameter of at least 0.3 μm, typically up to about 10 mm and often in the range of about 1.2 to 7 μm. Such diameters are the diameters of the tabular grain population selected to satisfy tabularity requirements. The term "equivalent circular diameter" (sometimes referred to hereinafter simply as ECD) is used in its art recognized sense to indicate the diameter of a circle having an area equal to that of the projected area of a grain. The term t in the aforementioned relationship is the mean thickness in μm of the tabular grains employed in the practice of this invention. It is subject to some variation, but it is normally less than about 0.40 μm, typically about 0.25 to 0.10 and often about 0.20 to 0.12 μm.

The tabular grain silver halide emulsions that form the emulsion layers of the radiographic elements of this invention have a significant bromide content which can be as high as 100 mole percent, based on total silver, as in the case of the tabular grain silver bromide or so-called "pure bromide" emulsions, although it can be less, as in the case of the silver bromochloride or silver bromoiodide emulsions. For example, the silver bromoiodide emulsions typically contain less than 15 mole percent iodide, based on total silver, often about 2 to 10 mole percent, although higher mole percentages of iodide can be useful in some situations. With the silver bromochloride emulsions, the chloride content is typically less than 50 mole percent, based on total silver, often about 15 to 45 mole percent, which can facilitate more rapid developability and achieve certain ecological advantages.

The class of azoles used in the practice of this invention comprise azoles containing a heterocyclic nitrogen containing ring having thereon a thiaalkylene moity that contains at least one sulfur atom which replaces carbon in an alkylene chain. Such compounds are effective to increase the covering power of the silver image upon development without any significant deleterious effect on the sensitivity of the silver bromide, silver bromochloride or silver bromoiodide emulsion layers containing such compounds. Suitable azoles of this type are monocyclic and polycyclic azoles such as triazoles, tetrazoles and substituted 1,3,3a,7-tetraazaindenes. As previously indicated herein, azoles useful in the practice of this invention can be represented by the following formula:

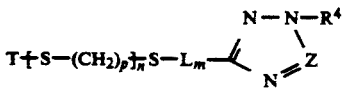

(I)

wherein Z is —N= or —C($R^5$)= where $R^5$ is hydrogen, —$NH_2$, aliphatic of 1 to 8 carbon atoms or aromatic of 1 to 8 carbon atoms; $R^4$ is hydrogen, aliphatic of 1 to 8 carbon atoms or aromatic of 1 to 8 carbon atoms; $R^4$ and $R^5$ together complete a 5 or 6 membered heterocyclic nucleus containing 1 to 3 ring nitrogen atoms; L is a divalent aliphatic linking group containing 1 to 8 carbon atoms; T is an aliphatic terminal group containing 1 to 10 carbon atoms; m is 0 or 1; n is an integer of 0 to 4 and p is an integer of 2 to 4.

Some illustrative $R^4$ and $R^5$ radicals of formula (I) that contain 1 to 8 carbon atoms, typically hydrocarbon and often containing 1 to 4 carbon atoms, include alkyl radicals such as methyl, ethyl, propyl, isopropyl, butyl, t-butyl and octyl; cycloalkyl radicals such as cyclopropyl, cyclobutyl, cyclopentyl and cyclohexyl; aralkyl radicals such as benzyl and phenethyl; aryl radicals such as phenyl and methylphenyl; fluoroalkyl such as fluoroethyl; dialkylaminoalkyl containing the same or different alkyls such as dimethylaminoethyl or diethylaminoethyl and acyclic radicals in which a carbon chain is interrupted by a hetero atom such as oxygen and/or sulfur, for example, at least one —O— or —S— atom interrupts a carbon chain. As indicated in the formula (I), $R^4$ and $R^5$ can be joined to complete a 5 or 6 membered heterocyclic nucleus containg 1 to 3 ring nitrogen atoms. Such nucleus is often a 6 membered heterocyclic nucleus containing 2 ring nitrogen atoms. Examples of suitable nuclei include a thiazole nucleus (for example, thiazole,4-methylthiazole), an oxazole nucleus (for example, oxazole,4-phenyloxazole), an isoxazole nucleus (for example, 5-methylisoxazole), a pyridine nucleus (for example, 2-pyridine,3-methyl-4-pyridine), a pyrimidine nucleus (for example, a 2-methyl-4-hydroxy pyrimidine), a pyrazine nucleus, a thiadiazole nucleus, a tetrazole nucleus, a triazine nucleus, a 1,2,4-triazole nucleus or a pyrazole nucleus. Such nuclei may be substituted on the ring by one or more of a wide variety of substituents but such substituents generally have only a limited effect on covering power. Examples of such substituents are hydroxy, halogen (for example, fluorine, chlorine, bromine, iodine), alkyl (for example, methyl, ethyl, propyl, butyl, pentyl, octyl), aryl (for example, phenyl,1-naphthyl,2-naphthyl), aralkyl (for example, benzyl, phenethyl), alkoxy (for example, methoxy, ethoxy), aryloxy (for example, phenoxy and 1-naphthyloxy), alkylthio (for example, methylthio, ethylthio), arylthio (for example, phenylthio, p-tolylthio, 2-naphthylthio), amino, including substituted amino (for example, anilino, dimethylamino, diethylamino, morpholino), acyl (for example, formyl, acetyl, benzoyl, benzenesulfonyl), carboalkoxy (for example, carboethoxy, carbomethoxy), or carboxy. Although the azoles used in the practice of this invention can include hetero atoms other than nitrogen in such ring nuclei, those containing nitrogen as the sole hetero atom in the nuclei are most readily available and/or more conveniently prepared. Accordingly, such azoles are preferred for use in this invention.

Some illustrative L substituents in formula (I), i.e. divalent aliphatic linking groups containing 1 to 8 carbon atoms, often 1 to 3 carbon atoms, include acyclic radicals such as alkylene, for example, methylene, ethylene, propylene, butylene or octylene; fluoroalkylene, such as fluorethylene, divalent acyclic radicals in which a carbon chain is interrupted by a hetero atom such as oxygen and/or sulfur, for example, at least one —O— and/or —S— atom interrupts a carbon chain. The aliphatic linking group is typically hydrocarbon and is unbranched, as exemplified by ethylene and propylene.

Some illustrative T aliphatic terminal groups in formula (I) containing 1 to 10 carbon atoms, typically 4 to 8 and often 6 to 8 carbon atoms, include acyclic radicals such as alkyl, for example, methyl, ethyl, propyl, butyl, isobutyl, octyl, nonyl and decyl; fluoroalkyl such as fluoroethyl, dialkylaminoalkyl containing the same or different alkyls such as dimethylaminoethyl or diethylaminoethyl and acyclic radicals in which a carbon chain is interrupted by a hetero atom such as oxygen and/or sulfur, for example, at least one —O— or —S— atom interrupts a carbon chain. Suitable aliphatic terminal groups are typically hydrocarbon groups such as alkyl.

In formula (I) n can be an integer from 0 to 4, but it is most often 0, 1 or 2, and while p can be an integer of 2 to 4, it is most often 2 or 3. Also, while m in formula (I) can be 0 or 1, it is most often 0.

The azoles used in this invention are available in the prior art and/or can be prepared using techniques well known to those skilled in the art. See, for example, U.S. Pat. Nos. 4,728,601; 4,720,447; 4,859,565 and 5,006,448, the disclosures of which are hereby incorporated herein by reference. In a typical synthesis, monocyclic azole compounds containing amino and alkylthio substituents are prepared by alkylating the corresponding mercapto substituted compounds in the presence of a base. Thus, 3-amino-5-mercapto-1,2,4-triazole can be reacted with an alkyl halide such as the chloride or bromide, in a suitable solvent in the presence of a base such as pyridine or sodium hydroxide. The resulting 3-amino-5-alkylthio-1,2,4-triazole compound can undergo a subsequent reaction with a $\beta$-keto ester such as ethyl acetoacetate, preferably under acidic conditions, to yield a 2-alkylthio-4-hydroxy-6-methyl-1,3,3a,7-tetraazaindene compound, which is also useful to increase the covering power of a developed silver image in accordance with the present invention. Such synthetic procedures are well known in the art, as illustrated by U.S. Pat. No. 4,728,601 cited previously herein.

A suitable procedure for preparing thiaalkylthiomethyl triazole compounds that can be employed in the practice of this invention comprises reacting an N'-formyl-2-chloroacetamidrazone with a thiolate, as described by I. Yanagisawa et al., *J. Med. Chem.*, 1984, Vol. 27, pp. 849–857.

A suitable procedure for preparing polythiaalkyl substituted tetrazole compounds that function as covering power increasing agents in this invention comprises alkylation of thiourea with an alkylthio substituted alkyl halide to yield a thiuronium salt which is reacted with potassium hydroxide, then with a cyano substituted alkyl halide to produce a polythiaalkyl substituted nitrile. This nitrile is then cyclized with sodium azide to yield the tetrazole compound. A suitable method of this type is described in synthesis Example B of U.S. Pat. No. 5,006,448, cited previously herein and incorporated by reference.

The following procedures are typical of those that can be used to prepare azoles for use in the radiographic elements of this invention. The compound numbers appearing in parentheses in such procedures correspond to those used in Table 1 which is set forth hereinafter, to identify the structure of such compound.

Synthesis of 3-amino-5-{2-[2-(hexylthio)ethylthio]ethylthio}-1,2,4-triazole (Compound 12)

A. Preparation of 2-[2-(hexylthio)ethylthio] ethanol

To a solution of sodium methoxide (5.9 g, 110 mmole) in methanol (200 mL) was added mercaptoethanol (8.91 g, 114 mmole) under a dry nitrogen atmosphere. 2-chloroethyl hexyl sulfide (15.67 g, 103 mmole) was added and the mixture was heated at reflux for two days. The mixture was then cooled and diluted with water and the organic solvents were removed under vacuum. The residue was diluted with more water and extracted three times with $CH_2Cl_2$. The combined extracts were washed with brine, dried over $MgSO_4$, and concentrated under vacuum to provide a quantitative yield of the above alkylthioethanol compound.

B. Preparation of 2-[2-(hexylthio)ethylthio]ethylchloride

Dry pyridine (6.8 mL, 84 mmole) was added under a dry nitrogen atmosphere to a chloroform solution (50 mL) of the alkylthioethanol compound (9.4 g, 42 mmole) prepared as described in A above. The mixture was cooled in a salt/ice bath, and p-toluenesulfonyl chloride (12.1 g, 63 mmole) was added. The ice bath was removed, and the mixture was allowed to stand for 2.5 hours, then treated with water (35 mL) and ether (150 mL). The ether portion was separated, washed successively with dilute HCl, saturated aqueous $NaHCO_3$, and brine, dried over $Na_2SO_4$, and concentrated under vacuum. The residue was purified by column chromatography on silica gel to give the above alkylthioethyl chloride compound (4.57 g, 45% yield).

C. Preparation of Compound 12

A mixture of the alkylthioethyl chloride (4.37 g, 20.5 mmole) prepared as described in B above, 3-amino-5-mercapto-1,2,4-triazole (2.64 g, 22.6 mmole), acetonitrile (39 mL), and pyridine (3 mL, 38 mmole) was heated at reflux overnight, cooled, and diluted with $H_2O$ (78 mL). The resulting precipitate was collected by filtration and dried under vacuum to obtain Compound 12 (4.8 g, 79% yield).

Synthesis of 3-amino-5-[2-(hexylthio)ethylthio]-1,2,4-triazole (Compound 6)

Compound 6 was prepared using the procedure used for Compound 12, but with 2-chloroethyl hexyl sulfide as the starting material. The yield was 86%. A portion was recrystallized from ligroin/ethyl acetate to obtain a solid, m.p. 76.5°–78° C. Analysis: Calculated for $C_{10}H_{20}N_4S_2$: C, 46.12; H, 7.74; N, 21.51. Found: C, 46.00; H, 7.56; N, 21.56.

Synthesis of 3-amino-5-[2-(octylthio)ethylthio]-1,2,4-triazole (Compound 7)

Compound 7 was prepared by using the procedure used for Compound 12, but with 2-chloroethyl octyl sulfide as the starting material. The yield was 96%. A portion was recrystallized from ligroin/ethyl acetate to obtain a solid, m.p. 85°–86° C. Analysis: Calculated for $C_{12}H_{24}N_4S_2$: C, 49.96; H, 8.39; N, 19.42. Found: C, 49.54; H, 8.12; N, 19.29.

Synthesis of 3-amino-5-[3-(pentylthio)propylthio]-1,2,4-triazole (Compound 9)

A. Preparation of 3-chloropropyl pentyl sulfide.

A suspension of sodium hydride (4.0 g, 100 mmole) in dry tetrahydrofuran (350 mL) under a nitrogen atmosphere was cooled in an ice bath. Pentyl mercaptan (10.8 g, 100 mmole) was added dropwise over 10 minutes. The resulting suspension of sodium alkylmercaptide was added in portions over 30 minutes to a stirred solution of 1-chloro-3-iodopropane (20.44 g, 100 mmole) in tetrahydrofuran (450 mL) that had been cooled to −78° C. The mixture was allowed to warm to ambient temperature overnight, then washed with brine, dried over $MgSO_4$, and concentrated under vacuum. The resultant oil was distilled under water aspirator pressure to yield the desired product (10.67 g, 59% yield), b.p. 113°-119° C. (20 mm Hg).

B. Preparation of Compound 9.

Compound 9 was prepared from a mixture of 3-chloropropyl pentyl sulfide,3-amino-5-mercapto-1,2,4-triazole and pyridine in acetonitrile, as described previously for Compound 12. The reaction mixture was poured into water and extracted with $CH_2Cl_2$. The extracts were washed with water and brine, dried over $MgSO_4$, and concentrated under vacuum to provide Compound 9 in 71% yield.

Synthesis of
2-{2-[2-(hexylthio)ethylthio]ethylthio}-4-hydroxy-6-methyl-1,3,3a,7-tetraazaindene (Compound 20).

A mixture of Compound 12 (3.90 g, 13.3 mmole), ethyl acetoacetate (1.94 g, 14.9 mmole), and acetic acid (8.2 mL) was heated at reflux in a dry nitrogen atmosphere overnight. On cooling, the mixture solidified. The solid was collected, washed with cold ethanol and recrystallized from ethanol to yield Compound 20 (4.03 g, 74% yield), m.p. 119°-121° C. Analysis: Calculated for $C_{10}H_{26}N_4OS_3$: C, 49.71; H, 6.78; N, 14.49. Found: C, 48.98; H, 6.76; N, 14.34.

Synthesis of
2-[2-(hexylthio)ethylthio]-4-hydroxy-6-methyl-1,3,3a,7-tetraazaindene (Compound 13)

Compound 13 was prepared from Compound 6, using a procedure analogous to that described previously for Compound 20. The crude product was recrystallized from ethyl acetate to give a white solid, m.p. 125.5°-126° C. Analysis: Calculated for $C_{14}H_{22}N_4OS_2$: C, 51.50; H, 6.79; N, 17.16. Found: C, 50.87; H, 6.62; N, 17.04.

Synthesis of
2-[2-(octylthio)ethylthio]-4-hydroxy-6-methyl-1,3,3a,7-tetraazaindene (Compound 14)

Compound 14 was prepared from Compound 7 using a procedure analogous to that described previously for Compound 20. Recrystallization of the crude product from ethyl acetate gave a 59% yield of a white solid, m.p. 125.5°-127° C. Analysis: Calculated for $C_{16}H_{26}N_4OS_2$: C, 54.21; H, 7.39; N, 15.80. Found: C, 53.51; H, 7.21; N, 15.72.

Synthesis of
2-[3-(pentylthio)propylthio]-4-hydroxy-6-methyl-1,3,3a,7-tetraazaindene (Compound 18)

Compound 18 was prepared from Compound 9, using a procedure analogous to that described previously for Compound 20. The crude product was recrystallized from ethyl acetate to give a 24% yield of white solid, m.p. 121°-123° C. Analysis: Calculated for $C_{14}H_{22}N_4OS_2$: C, 51.50; H, 6.79; N, 17.16. Found: C, 61.30; H, 6.69; N, 16.97.

A partial listing of azoles that can be used as covering power increasing compounds in the practice of this invention are set forth in the following Table I. Such compounds are identified as Compounds 1-30 in the following Table I and corresponding numbers are used to identify such compounds in the following Examples which illustrate this invention.

TABLE I

| | |
|---|---|
| 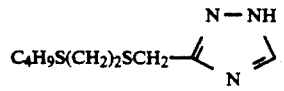 | Compound 1 |
| 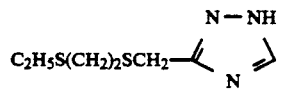 | Compound 2 |
| 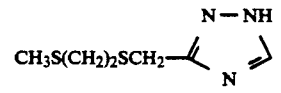 | Compound 3 |
| 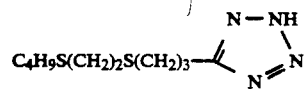 | Compound 4 |
| 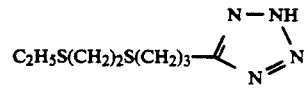 | Compound 5 |
| 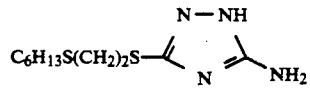 | Compound 6 |
| 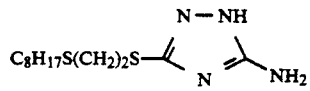 | Compound 7 |
| 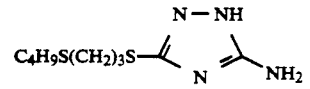 | Compound 8 |
| 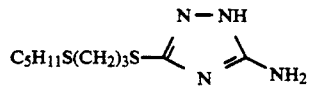 | Compound 9 |
| 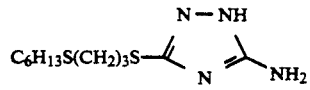 | Compound 10 |
| 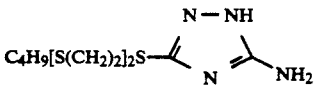 | Compound 11 |
| 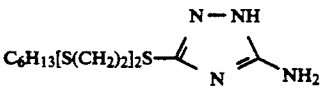 | Compound 12 |
| 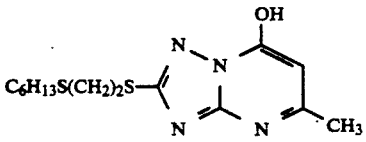 | Compound 13 |
| 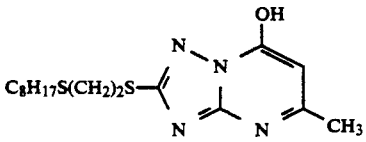 | Compound 14 |

TABLE I-continued

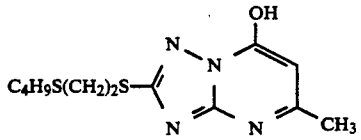

Compound 15

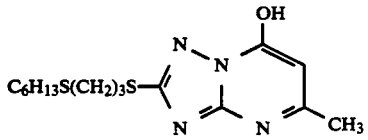

Compound 16

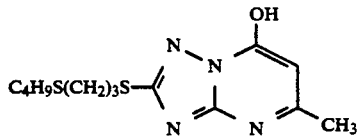

Compound 17

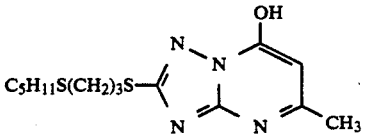

Compound 18

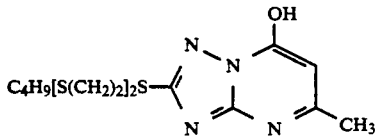

Compound 19

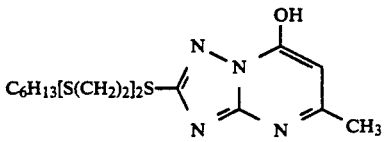

Compound 20

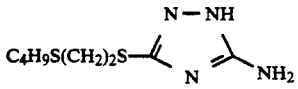

Compound 21

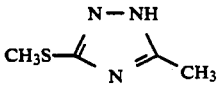

Compound 22

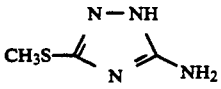

Compound 23

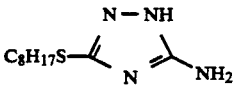

Compound 24

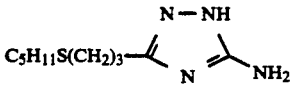

Compound 25

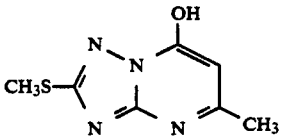

Compound 26

TABLE I-continued

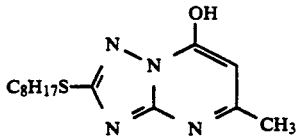

Compound 27

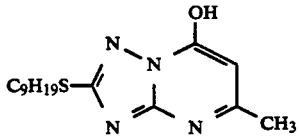

Compound 28

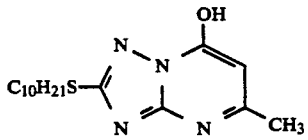

Compound 29

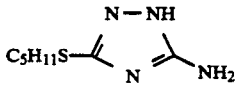

Compound 30

The azole covering power enhancing compounds of formula (I) can be used in any concentration effective to modify the covering power of a developed silver image according to this invention. As will be recognized by those skilled in the art, the optimum concentration will depend upon several factors, including, for example, the type and dimensions of the radiation sensitive silver halide grains used, the amount of hydrophilic colloid binder or vehicle in the emulsion layer, the layer in which the azole compound is located, the processing chemistry and conditions used and the concentration of silver halide coated. Typically, a significant enhancement in covering power is achieved with concentrations of the azoles in the range of about 0.02 to 10 grams per mole of silver, although concentrations in the range of about 0.2 to 5, often about 2 to 3 grams per mole of silver usually provide optimal results. Such compounds can be incorporated into the photographic element in various locations using techniques known to those skilled in the art. For example, such compounds may simply be added to an emulsion layer as an aqueous solution or as a solution in an organic solvent such as methanol. Such solutions can also be added to other layers of the photographic element, preferably layers contiguous to the emulsion layer, for example an overcoat or an underlayer. The azoles can be added in any convenient form, for example, they can be added in the form of solid dispersions comprising solid azole, a vehicle such a gelatin and a suitable surfactant. The use of a solid dispersion is particularly effective when it is desired to minimize interaction of the azole covering power modifier with other addenda already present in the photographic element. Such addenda include, for example, spectral sensitizing dyes that are absorbed onto the silver halide grain surfaces.

Both for purposes of achieving maximum imaging speed and minimizing crossover where the radiographic elements are "double coated", the tabular grain emulsions are substantially optimally spectrally sensitized. That is, sufficient spectral sensitizing dye is adsorbed to the emulsion grain surfaces to achieve at least 60 percent of the maximum speed attainable from the emulsions under the contemplated conditions of exposure. It is known that optimum spectral sensitization is achieved at about 25 to 100 percent or more of monolayer coverage of the total available surface area presented by the grains. The preferred dyes for spectral sensitization are polymethine dyes, such as cyanine, merocyanine, hemicyanine, hemioxonol, and merostyryl dyes. Specific examples of spectral sensitizing dyes and their use to sensitize tabular grain emulsions are provided by Kofron et al., U.S. Pat. No. 4,439,520, hereby incorporated herein by reference.

Although not a required feature of the invention, the tabular grain emulsions are rarely put to practical use without chemical sensitization. Any convenient chemical sensitization of the tabular grain emulsions can be undertaken. The tabular grain emulsions are preferably chemically and spectrally sensitized. Useful chemical sensitizations, including noble metal (e.g., gold) and chalcogen (e.g., sulfur and/or selenium) sensitizations, as well as selected site epitaxial sensitizations, are disclosed by U.S. Pat. Nos. 4,439,530 and 4,425,501 relating to tabular grain emulsions.

In addition to the grains and spectral sensitizing dye the emulsion layers used in this invention can include as vehicles any one or combination of various conventional hardenable hydrophilic colloids alone or in combination with vehicle extenders, such as latices and the like. The vehicles and vehicle extenders can be selected from among those disclosed by *Research Disclosure*, Vol. 176, December 1978, Item 17643, Section IX, Vehicle and Vehicle Extenders, hereby incorporated herein by reference. Specifically preferred hydrophilic colloids are gelatin and gelatin derivatives. *Research Disclosure* is published by Kenneth Mason Publications, Ltd., Dudley Annex, 21a Worth Street, Elmsworth, Hampshire P010 7DQ, England.

The coating coverages of the emulsion layers are chosen to provide on processing the desired maximum density levels. For radiography maximum density levels are generally in the range of from about 3 to 4, although specific applications can call for higher or lower density levels. Since the silver images produced on opposite sides of the support in "double coated" radiographic element are superimposed during viewing, the optical density observed is the sum of the optical densities provided by each emulsion layer. Assuming equal silver coverages on opposite major surfaces of the support, each emulsion layer generally contains a silver coverage from about 18 to 30 mg/dm$^2$, preferably 21 to 27 mg/dm$^2$.

It is conventional practice to protect emulsion layers in radiographic elements from damage by providing overcoat layers. The overcoat layers can be formed of the same vehicles and vehicle extenders disclosed herein in connection with the emulsion layers. The overcoat layers are most commonly gelatin or a gelatin derivative.

To avoid wet pressure sensitivity the total hydrophilic colloid coverage on each major surface of a support is generally at least 35 mg/dm$^2$. However, to allow rapid-access processing of the radiographic element, i.e. complete processing in 90 seconds or less, the total hydrophilic coating coverage on each major surface of a support is usually less than 65 mg/dm$^2$, preferably less than 55 mg/dm$^2$, and the hydrophilic colloid layers are substantially fully forehardened. By substantially fully forehardened it is meant that the processing solution permeable hydrophilic colloid layers are forehardened in an amount sufficient to reduce swelling of these layers to less than 300 percent, percent swelling being determined by the following reference swell determination procedure: (a) incubating said radiographic element at 38° C. for three days at 50 percent relative humidity, (b) measuring layer thickness, (c) immersing said radiographic element in distilled water at 21° C. for three minutes, and (d) determining the percent change in layer thickness as compared to the layer thickness measured in step (b). This reference procedure for measuring forehardining is disclosed by Dickerson U.S. Pat. No. 4,414,304. Employing htis reference procedure, it is preferred that hydrophilic colloid layers be sufficiently forehardened that swelling is reduced to less than 200 percent under the stated test conditions.

Any conventional transparent radiographic element support can be employed in the elements of this invention. Transparent film supports, such as any of those disclosed in *Research Disclosure*, Item 17643, cited previously herein, Section XIV, are all contemplated. Due to their superior dimensional stability the transparent film supports preferred are polyester supports. Poly(ethylene terephthalate) is a specifically preferred polyester film support. The support is typically tinted blue to aid in the examination of image patterns. Blue anthracene dyes are typically employed for this purpose. In addition to the film itself, the support is usually formed with a subbing layer to improve the bonding of hydrophilic colloid containing layers to the support. For further details of support construction, including exemplary incorporated anthracene dyes and subbing layers, refer to *Research Disclosure*, Vol. 184, August 1979, Item 18431, Section XII.

In addition to the features of the radiographic elements of this invention set forth herein, it is recognized that the radiographic elements can and in most practical applications will contain additional conventional features. Referring to *Research Disclosures*, Item 18431, cited previously, the emulsion layers can contain stabilizers, antifoggants, and antikinking agents of the type set forth in Section II. The outermost layers of the radiographic element can also contain matting agents of the type set out in *Research Disclosure*, Item 17643, cited previously, Section SVI. Referring further to *Research Disclosure*, Item 17643, incorporation of the coating aids of Section XI, the plasticizers and lubricants of Section XII, and the antistatic layers of Section XIII, are each contemplated.

The following explanation, measurement technique and Examples are presented to further illustrate the invention.

ANALYSIS OF COVERING POWER

Covering power (CP) for a developed silver image is generally recognized to be the optical density of the image divided by the mass per unit area as represented by the relationship CP=D/M. Optical density is a dimensionless value. Mass per unit area (M) is normally expressed in grams/ft$^2$ or grams/dm$^2$ so that the units of covering power are units of area per gram of silver.

In the following Examples, the optical densities (D) of the samples of the radiographic elements were determined as transmission visual neutral densities measured with a conventional densitometer. The amount of silver per unit area (M) was measured with a conventional X-ray fluorescence spectrometer.

In the following Examples, the samples of the radiographic elements were exposed to spectral radiation simulating a green-emitting X-ray intensifying screen using a 21 increment (0.2 log E) step wedge to achieve sensitometric gradations in exposure. Covering power was evaluated by measuring the visual neutral densities and amounts per unit area of developed silver for each exposure step. The covering power was calculated as the slope of the line relating optical density to developed silver in those regions and reported as the mean ratio of density to developed silver throughout the exposure scale. For ease of comparison, the relative covering power is also reported in the following Examples.

The azoles used in the samples analyzed are identified in the tables using the corresponding numbers that were used to identify such azoles in Table I set forth hereinbefore. Except for variations in azole compounds and concentrations, or those specifically identified in the following tables, all other features of the samples analyzed in the processing conditions were kept constant to provide valid covering power comparisons. In addition, the tabular grain emulsions used and identified in the Examples consisted predominently of tabular grains, in all instances greater than 90 percent tabular grains, based on total grain population projected area.

EXAMPLE 1

A series of radiographic elements were prepared using the following three tabular grain silver bromide emulsions:

| Emulsion | ECD (μm) | Grain Thickness (μm) | Tabularity (ECD/$t^2$) |
|---|---|---|---|
| A | 1.8 | 0.086 | 243 |
| B | 1.7 | 0.100 | 170 |
| C | 1.8 | 0.130 | 107 |

In each of the radiographic elements an emulsion layer was coated on a blue tinted polyester support at a coverage of 21.5 mg/$dm^2$ silver and 32 mg/$dm^2$ gelatin. The emulsion was chemically sensitized with conventional sulfur and gold sensitizers and in some cases spectrally sensitized to green light with an oxacarbocyanine dye at 400 mg/Ag mole. In some series of coatings, the emulsion layer also contained a stabilizer, 4-hydroxy-6-methyl-1,3,3a,7-tetraazaindene, which is not an active covering power enhancing compound. A gelatin overcoat at 9 mg/$dm^2$ gelatin was coated over the emulsion layer. The layers were hardened with bis(vinylsulfonylmethyl)ether at 1.0 percent of the total gelatin weight.

The azoles were coated in the emulsion layers in the form of solid particle dispersions. Such a dispersion was prepared by milling the azole in an aqueous slurry with gelatin and a surfactant. The dispersion contained 3 percent, by weight, azole, 3 percent, by weight, gelatin and 0.5 percent, by weight, surfactant. The azoles were coated at coverages of from 0.02 to 10 g/Ag mole.

Samples of the radiographic elements were exposed with either 365 nm light, where no spectral sensitizer was present in the coating, or with green light using the 21 increment step wedge as previously described herein. Exposed radiographic elements were processed in 90 seconds in a commercially available Kodak RP X-Omat (Model 6B) rapid-access processor as follows:

| | |
|---|---|
| Development | 20 seconds at 40° C. |
| Fixing | 12 seconds at 40° C. |
| Washing | 8 seconds at 40° C. |

-continued

| | |
|---|---|
| Drying | 20 seconds at 65° C. |

where the remaining time was taken up in transport between processing steps. The development step employed the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |

Water to 1 liter at pH 10.0, and the fixing step employed the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 | |

The resulting covering power values for the series of samples, measured as described in the Analysis of Covering Power section set forth hereinbefore, were as follows:

TABLE 2

| Emulsion | Azole | Concentration (g/Ag mole) | Covering Power $dm^2$/g | Relative Covering Power |
|---|---|---|---|---|
| A | None | — | 114 | 1.00 |
| | 7 | 3.0 | 125 | 1.09 |
| | 8 | 3.0 | 131 | 1.14 |
| | 20 | 1.0 | 145 | 1.27 |
| | 20 | 5.0 | 135 | 1.20 |
| | 20 | 10.0 | 139 | 1.22 |
| | None | — | 112 | 1.00 |
| | 13 | 0.2 | 124 | 1.10 |
| | 13 | 0.5 | 133 | 1.18 |
| | None | — | 112 | 1.00 |
| | 14 | 0.2 | 140 | 1.25 |
| | None | — | 115 | 1.00 |
| | 7 | 0.1 | 120 | 1.04 |
| | 7 | 0.2 | 123 | 1.06 |
| | 7 | 0.5 | 128 | 1.11 |
| | 7 | 1.0 | 133 | 1.15 |
| | 10 | 0.1 | 115 | 1.00 |
| | 10 | 0.2 | 120 | 1.04 |
| | 10 | 0.5 | 135 | 1.17 |
| | 10 | 1.0 | 134 | 1.21 |
| | 19 | 0.1 | 120 | 1.04 |
| | 19 | 0.2 | 125 | 1.09 |
| | 19 | 0.5 | 141 | 1.23 |
| | 19 | 1.0 | 137 | 1.19 |
| B | None | 0.0 | 102 | 1.00 |
| | 15 | 0.5 | 124 | 1.21 |
| | 15 | 1.0 | 124 | 1.21 |
| | 15 | 2.0 | 122 | 1.19 |
| | 14 | 0.5 | 125 | 1.23 |
| | 14 | 1.0 | 124 | 1.21 |
| | 14 | 2.0 | 125 | 1.23 |
| C | None | — | 89 | 1.00 |
| | 15 | 1.0 | 112 | 1.25 |
| | 15 | 2.0 | 110 | 1.23 |
| | 13 | 1.0 | 110 | 1.23 |
| | 13 | 2.0 | 107 | 1.20 |
| | 17 | 1.0 | 112 | 1.25 |
| | 17 | 2.0 | 110 | 1.23 |
| | 19 | 1.0 | 109 | 1.22 |

TABLE 2-continued

| Emulsion | Azole | Concentration (g/Ag mole) | Covering Power $dm^2/g$ | Relative Covering Power |
|---|---|---|---|---|
| | 19 | 2.0 | 110 | 1.23 |

From the covering power values reported in the above Table 2, it is obvious that the azole compounds of formula (I) employed according to this invention are effective to enhance the covering power of a developed silver image in radiographic elements containing tabular grain silver bromide emulsion layers. From the results reported at the various concentrations of azole in Table 2, it is also obvious that optimum concentrations vary among the azoles, as discussed previously herein.

EXAMPLE 2

The preceding Example 1 illustrates that radiographic elements comprising tabular grain silver bromide emulsion layers are useful in the practice of this invention. Tabular grain silver bromoiodide layers are also useful. To illustrate, the procedure of Example 1 was repeated with the following silver bromoiodide (3 mole percent iodide) emulsion:

| Emulsion | Emulsion ECD (μm) | Thickness (μm) | Tabularity ($T = ECD/t^2$) |
|---|---|---|---|
| A | 1.7 | 0.140 | 87 |
| B | 1.2 | 0.150 | 53 |

The results are reported in the following Table 3.

TABLE 3

| Emulsion | Azole | Concentration (g/Ag mole) | Covering Power $dm^2/g$ | Relative Covering Power |
|---|---|---|---|---|
| A | None | — | 78 | 1.00 |
| | 14 | 0.2 | 101 | 1.29 |
| | 14 | 0.5 | 107 | 1.37 |
| B | None | — | 77 | 1.00 |
| | 24 | 2.0 | 102 | 1.32 |
| | 30 | 2.0 | 98 | 1.27 |

EXAMPLE 3

The optimum concentration of an azole that is used in the practice of this invention can vary with such factors as size and silver halide content and tabularity of the silver halide grains used in the emulsion layer. To illustrate this feature of the invention, the procedure of Example 1 was repeated using the following emulsions.

| Emulsion | Emulsion Composition (mole percent) | ECD (μm) | Thickness (μm) | Tabularity ($T = ECD/t^2$) |
|---|---|---|---|---|
| A | AgBr (100) | 0.34 | 0.057 | 105 |
| B | AgBR (100) | 2.30 | 0.065 | 544 |
| C | AgBr (100) | 1.80 | 0.086 | 243 |
| D | AgBr (100) | 3.40 | 0.110 | 281 |
| E | AgBr (100) | 1.80 | 0.130 | 107 |
| F | AgBr (85) Cl (15) | 1.00 | 0.100 | 100 |
| G | AgBr (97) I (3) | 1.70 | 0.140 | 87 |

The results are reported in the following Table 4.

TABLE 4

| Emulsion | Azole | Concentration (g/Ag mole) | Power $dm^2/g$ | Relative Covering Power |
|---|---|---|---|---|
| A | None | 0.0 | 163 | 1.00 |
| | 8 | 0.2 | 176 | 1.08 |
| | 8 | 0.5 | 189 | 1.16 |
| B | None | 0.0 | 126 | 1.00 |
| | 8 | 2.0 | 163 | 1.29 |
| C | None | 0.0 | 112 | 1.00 |
| | 8 | 0.2 | 140 | 1.25 |
| D | None | 0.0 | 99 | 1.00 |
| | 8 | 0.2 | 116 | 1.17 |
| | 8 | 0.4 | 123 | 1.23 |
| E | None | 0.0 | 89 | 1.00 |
| | 8 | 0.2 | 102 | 1.15 |
| | 8 | 1.0 | 112 | 1.27 |
| F | None | 0.0 | 114 | 1.00 |
| | 8 | 2.0 | 127 | 1.11 |
| G | None | 0.0 | 74 | 1.00 |
| | 8 | 0.5 | 107 | 1.44 |

The invention has been described in detail with particular reference to preferred embodiments thereof, but it will be understood that variations and modifications can be effected within the spirit and scope of the invention.

We claim:

1. A silver image forming radiographic element comprised of a transparent support and coated thereon at least one hydrophilic colloid layer including an emulsion layer containing radiation sensitive silver bromide, silver bromochloride or silver bromoiodide grains having a mean equivalent circular diameter of at least 0.3 μm and a grain population wherein at least 50 percent of the total grain population projected area is accounted for by tabular grains having a tabularity of greater than 8, as determined by the relationship:

$$T = \frac{ECD}{t^2}$$

wherein

T is tabularity;

ECD is the mean effective circular diameter in μm of the tabular grains; and t is the mean thickness in μm of the tabular grains, said element including in said emulsion layer or in a hydrophilic colloid layer contiguous to said emulsion layer an azole in a concentration effective to increase the covering power of the silver image, the azole having the formula:

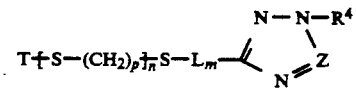

(I)

wherein

Z is —N= or —C($R^5$)=;

L is a divalent aliphatic linking group containing 1 to 8 carbon atoms;

T is an aliphatic terminal group containing 1 to 10 carbon atoms;

m is 0 or 1;

n is an integer of 2 to 4;

p is an integer of 2 to 4 and $R^4$ and $R^5$ together complete a 5 or 6 member heterocyclic nucleus containing 1 to 3 ring nitrogen atoms or $R^4$ is hydrogen, an aliphatic group of 1 to 8 carbon atoms or an aromatic group of 1 to 8 carbon atoms and $R^5$ is hydrogen, $—NH_2$, an aliphatic group of 1 to 8 carbon atoms or an aromatic group of 1 to 8 carbon atoms.

2. The element of claim 1, wherein Z is $—C(R^5)=$ and $R^4$ and $R^5$ together complete a six membered heterocyclic nucleus containing 2 ring nitrogen atoms.

3. The element of claim 2, wherein p is 2.

4. The element of claim 3, wherein m is 0.

5. The element of claim 4, wherein n is 2.

6. The element of claim 5, wherein T contains 4 to 8 carbon atoms.

7. The element of claim 2, wherein the concentration of the azole is in the range of about 0.02 to 10 grams per mole of silver.

8. The element of claim 1, wherein about 70 to 90 percent of the total grain population projected area is accounted for by tabular grains having a tabularity greater than 25.

9. The element of claim 8, wherein the tabular grains are silver bromide grains.

10. The element of claim 8, wherein the tabular grains are silver bromoiodide grains.

11. A silver image forming radiographic element comprised of a transparent support and coated thereon at least one hydrophilic colloid layer including an emulsion layer containing radiation sensitive silver bromide, silver bromochloride or silver bromoiodide grains having a mean equivalent circular diameter of at least 0.3 μm and a grain population wherein at least 50 percent of the total grain population projected area is accounted for by tabular grains having a tabularity of greater than 8, as determined by the relationship:

$$T = \frac{ECD}{t^2}$$

wherein

T is tabularity;

ECD is the mean effective circular diameter in μm of the tabular grains; and t is the mean thickness in μm of the tabular grains, said element including in said emulsion layer or in a hydrophilic colloid layer contiguous to said emulsion layer an azole in a concentration effective to increase the covering power of the silver image, the azole having the formula:

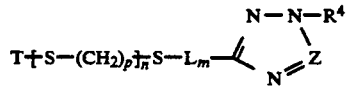

wherein

Z is —N=or $—C(R^5)=$ $R^5$ is hydrogen, $—NH_2$, an aliphatic group of 1 to 8 carbon atoms or an aromatic group of 1 to 8 carbon atoms;

$R^4$ is hydrogen, an aliphatic group of 1 to 8 carbon atoms or an aromatic group of 1 to 8 carbon atoms;

L is a divalent aliphatic linking group containing 1 to 8 carbon atoms;

T is an aliphatic terminal group containing 1 to 10 carbon atoms;

m is 0 or 1;

n is an integer of 0 to 4; and p is an integer of 2 to 4.

12. The element of claim 11, wherein Z is $—C(R^5)=$ where $R^5$ is hydrogen, and $R^4$ is hydrogen.

13. The element of claim 12, wherein p is 2, m is 0, n is 1 or 2 and T contains 4 to 8 carbon atoms.

14. The element of claim 13, wherein the tabular grains are silver bromide grains.

15. The element of claim 13, wherein the tabular grains are silver bromoiodide grains.

16. The element of claim 13, wherein the tabular grains are silver bromochloride grains.

* * * * *